US009445197B2

(12) United States Patent
Oswald et al.

(10) Patent No.: US 9,445,197 B2
(45) Date of Patent: Sep. 13, 2016

(54) SIGNAL PROCESSING FOR A HEADREST-BASED AUDIO SYSTEM

(71) Applicant: Bose Corporation, Framingham, MA (US)

(72) Inventors: Charles Oswald, Arlington, MA (US); Michael S. Dublin, Arlington, MA (US); Tobe Z. Barksdale, Bolton, MA (US); Wontak Kim, Cambridge, MA (US); Jahn Dmitri Eichfeld, Natick, MA (US)

(73) Assignee: Bose Corporation, Framington, MA (US)

( * ) Notice: Subject to any disclaimer, the term of this patent is extended or adjusted under 35 U.S.C. 154(b) by 495 days.

(21) Appl. No.: 13/888,927

(22) Filed: May 7, 2013

(65) Prior Publication Data

US 2014/0334637 A1 Nov. 13, 2014

(51) Int. Cl.

| | |
|---|---|
| ***H04R 5/00*** | (2006.01) |
| ***H04R 3/12*** | (2006.01) |
| ***H04S 7/00*** | (2006.01) |
| *H04S 5/00* | (2006.01) |

(52) U.S. Cl.

CPC . *H04R 3/12* (2013.01); *H04S 7/30* (2013.01); *H04R 2499/13* (2013.01); *H04S 5/00* (2013.01); *H04S 2420/01* (2013.01)

(58) Field of Classification Search

CPC ..... H04S 2400/01; H04S 2400/03; H04S 2400/05; H04S 2420/01; H04R 2499/13; H04R 5/02; H04R 5/023; H04R 2205/024; H04R 1/025; B60R 11/0217

USPC ..... 381/86, 301, 302

See application file for complete search history.

(56) References Cited

U.S. PATENT DOCUMENTS 4,293,821 A * 10/1981 Boudouris et al. ..... 330/126
4,747,142 A * 5/1988 Tofte ..... 381/27

(Continued)

FOREIGN PATENT DOCUMENTS

| | | | |
|---|---|---|---|
| EP | 1858296 | A1 | 11/2007 |
| JP | 2006080886 | A | 3/2006 |
| WO | 2007096808 | A1 | 8/2007 |

OTHER PUBLICATIONS

International Search Report and Written Opinion dated Oct. 28, 2014 for International application No. PCT/US2014/035598.

(Continued)

*Primary Examiner* — Duc Nguyen
*Assistant Examiner* — Kile Blair
(74) *Attorney, Agent, or Firm* — Bose Corporation

(57) ABSTRACT

An automobile audio system having at least two near-field speakers located close to an intended position of a listener's head is configured by determining a first binaural filter that causes sound produced by each of the near-field speakers to have characteristics at the intended position of the listener's head of sound produced by a sound source located at a first designated position other than the actual locations of the near-field speakers, determining an up-mixing rule to generate at least three component channel signals from an input audio signal having at least two channels, and configuring the audio system to, determine a first binaural signal corresponding to a combination of the component channel signals originating at the first designated position, and filter the first binaural signal using the first binaural filter and to output the filtered signals using the near-field speakers.

4 Claims, 7 Drawing Sheets

(56) References Cited

U.S. PATENT DOCUMENTS

| | | | | |
|---|---|---|---|---|
| 5,193,118 | A * | 3/1993 | Latham-Brown et al. | 381/86 |
| 7,092,531 | B2 | 8/2006 | Enya et al. | |
| 7,630,500 | B1 * | 12/2009 | Beckman et al. | 381/18 |
| 7,792,674 | B2 | 9/2010 | Dalton, Jr. et al. | |
| 8,472,652 | B2 * | 6/2013 | Harma | 381/307 |
| 9,167,344 | B2 | 10/2015 | Choueiri | |
| 2003/0142835 | A1 * | 7/2003 | Enya et al. | 381/86 |
| 2005/0018860 | A1 | 1/2005 | Furge et al. | |
| 2005/0213528 | A1 | 9/2005 | Aarts et al. | |
| 2006/0045294 | A1 | 3/2006 | Smyth | |
| 2006/0115091 | A1 * | 6/2006 | Kim et al. | 381/18 |
| 2006/0198527 | A1 | 9/2006 | Chun | |
| 2006/0222182 | A1 | 10/2006 | Nakaishi et al. | |
| 2008/0037794 | A1 | 2/2008 | Sugawara et al. | |
| 2008/0221907 | A1 * | 9/2008 | Pang et al. | 704/500 |
| 2008/0273712 | A1 * | 11/2008 | Eichfeld et al. | 381/86 |
| 2008/0292121 | A1 * | 11/2008 | Yokota | 381/301 |
| 2009/0296943 | A1 * | 12/2009 | Martin | 381/17 |
| 2009/0316939 | A1 | 12/2009 | Matsumoto et al. | |
| 2013/0177187 | A1 | 7/2013 | Mentz | |
| 2013/0178967 | A1 | 7/2013 | Mentz | |
| 2014/0133658 | A1 | 5/2014 | Mentz et al. | |

OTHER PUBLICATIONS

Bai M R et al: 'Upmixing and Downmixing Two-channel Stereo Audio for Consumer Electronics', IEEE Transactions on Consumer Electronics, IEEE Service Center, New York, NY, US, vol. 53, No. 3, Aug. 1, 2007, pp. 1011-1019, XP011193644, ISSN: 0098-3063, DOI: 10. 1109/TCE.2007.4341580 section IV, "Integration of upldownmixing algorithms"; p. 1014.

Invitation to Pay Additional Fees dated Aug. 7, 2014 for International application No. PCT/US2014/035598.

* cited by examiner

SIGNAL PROCESSING FOR A HEADREST-BASED AUDIO SYSTEM

BACKGROUND

This disclosure relates to a modular headrest-based audio system.

In some automobile audio systems, processing is applied to the audio signals provided to each speaker based on the electrical and acoustic response of the total system, that is, the responses of the speakers themselves and the response of the vehicle cabin to the sounds produced by the speakers. Such a system is highly individualized to a particular automobile model and trim level, taking into account the location of each speaker and the absorptive and reflective properties of the seats, glass, and other components of the car, among other things. Such a system is generally designed as part of the product development process of the vehicle and corresponding equalization and other audio system parameters are loaded into the audio system at the time of manufacture or assembly.

SUMMARY

An audio system for a passenger car includes a set of speakers fixed in the vehicle cabin, and speakers located near at least one passenger's head, such as in the car's headrests. Audio signals are up-mixed into virtual speaker locations and then re-mixed based on the binaural audio response from the headrest speakers to enhance the sound presentation by the fixed speakers.

In general, in one aspect, an automobile audio system having at least two near-field speakers located close to an intended position of a listener's head is configured by determining a first binaural filter that causes sound produced by each of the near-field speakers to have characteristics at the intended position of the listener's head of sound produced by a sound source located at a first designated position other than the actual locations of the near-field speakers, determining an up-mixing rule to generate at least three component channel signals from an input audio signal having at least two channels, and configuring the audio system to, determine a first binaural signal corresponding to a combination of the component channel signals originating at the first designated position, and filter the first binaural signal using the first binaural filter and to output the filtered signals using the near-field speakers.

Implementations may include one or more of the following, in any combination. The sound source may include a synthetically generated source. The sound source may include a plurality of synthetically generated sources in combination. The frequency response equalization of the phase or magnitude of the signals from the plurality of sources may be adjusted before combining the signals to produce each sound source. Determining second and third binaural filters that cause sound produced by each of the near-field speakers to have characteristics at the intended position of the listener's head of sound produced by sound sources located at respective second and third designated positions other than the actual location of the near-field speakers, configuring the audio system to determine second and third binaural signals corresponding to combinations of the component channel signals originating at the respective second an third designated positions and filter the second and third binaural signals using the second and third binaural filters, and to combine the first, second, and third filtered binaural signals when outputting the filtered signals using the near-field speakers. Combining the filtered binaural signals may include computing a weighted sum of each of the first, second, and third filtered binaural signals. The steps of determining the first, second, and third binaural signals and combining the filtered binaural signals may be governed by constraints on the combination of component channel signals. The input audio signal may include exactly two channels. A first one of the component channel signals may correspond to a center channel, and a second one of the component channel signals may correspond to a left channel, with the first designated position centered behind the listener, the second and third designated positions spaced different directions away from but both on the left side of the listener, and the first, second, and third filtered binaural signals combined such that the listener will perceive the center channel signal as originating from a precise location, and will perceive the surround channel signal as originating from a diffuse location.

The automobile audio system may include at least first and second speakers in fixed locations other than the location of the near-field speakers, and the audio system may be configured to determine first and second monaural signals corresponding to first and second respective combinations of the component channel signals and output the first and second monaural signal using the respective first and second speakers in fixed locations. At least one of the component channel signals may correspond to a left component, at least another one of the component channel signals may correspond to a right component, with the first speaker in a fixed location on the left side of the vehicle, and determining the first monaural signal may include combining the left component and the right component signals.

The first binaural signal and the first and second monaural signals may be configured to control perception of the location of sound by the listener, the first binaural sound controlling the perception for sounds in a first frequency band, and the first and second monaural signals controlling the perception for sounds in a second frequency band. The first binaural signal and the first and second monaural signals may be configured to control perception of the location of sound by the listener, the first binaural sound controlling the perception for a first subset of the component channel signals, and the first and second monaural signals controlling the perception for a second subset of the component channel signals. Filtering the first binaural signal may includes filtering the first binaural signal to prevent crosstalk between the at least two near-field speakers. Determining the first binaural signal may include computing a weighted sum of each of the component channel signals. Determining the first binaural signal may include applying filters to each of the component channel signals before computing their weighted sum. Determining the first binaural signal may include computing the weighted sum using different weights for sub-components of each of the component channel signals, the sub-components corresponding to signal content in different frequency bands. Determining the first binaural signal may include applying different filters to each of the sub-components before computing their weighted sum.

In general, in one aspect, an automobile audio system includes at least two near-field speakers located near an intended position of a listener's head, and an audio signal processor configured to receive an input audio signal having at least two channels, use an up-mixing rule to generate at least three component channel signals from the input audio signal, determine a first binaural signal corresponding to a combination of the component channel signals originating at a first designated position other than the locations of the near-field speakers, filter the first binaural signal using a first filter, the first filter causing sound produced by the near-field speakers to have characteristics at an intended position of a listener's head of sound produced by a sound source located at the first designated position, and provide the filtered first binaural signal to the near-field speakers.

Implementations may include one or more of the following, in any combination. The system may not include fixed speakers in the vehicle cabin located rearward of the intended position of the listener's head. The first near-field speaker may include at least two electroacoustic transducers, at least one located at either end of a headrest. The audio signal processor may be configured to filter the first binaural signal to control cross-talk of signals between each of the near-field speakers and an ear of the listener positioned closer to a different one of the near-field speakers. The first near-field speaker may include a pair of arrays of electroacoustic transducers located at either end of a headrest. The first near-field speaker may include an array of electroacoustic transducers located inside a headrest. An array of speakers may be located forward of the near-field speakers, the first designated position may be forward of the listener, and the audio signal processor may be further configured to filter the first binaural signal such that sound perceived by the listener appears to come from the first designated position.

In general, in one aspect, mixing audio signals includes receiving a number M of input channels, wherein M may be two or more, up-mixing the input channels into a number N of component channels, wherein N may be greater than M, adjusting the frequency response equalization of the phase or magnitude of each the N component channels, the adjustment being different for at least two of the N component channels, re-mixing the adjusted component channels into a number P of output channels, and providing the P output channels.

Implementations may include one or more of the following, in any combination. P may be equal to N. Re-mixing the adjusted component channels may include generating each output channel and computing a weighted sum of a subset of the adjusted component channels. Generating a number Q of binaural signal pairs from the N component channels, adjusting the frequency response equalization of the phase or magnitude of each the Q binaural signal pairs, the adjustment being different for at least two of the Q binaural signal pairs, and re-mixing the adjusted binaural signal pairs into a number R of binaural output channels. Generating a number Q of binaural signal pairs from the adjusted component channels, and re-mixing the adjusted binaural signal pairs into a number R of binaural output channels.

Advantages include providing a cost-effective solution for delivering a high-quality audio experience in a small car, providing surrounding and enveloping audio without the need for rear-seat speakers. The system provides more control of soundstage and can create a more symmetrical experience than is achieved in conventional systems. Sound can be delivered from more locations than there are physical speakers, including locations where physical speakers would be impossible to package.

All examples and features mentioned above can be combined in any technically possible way. Other features and advantages will be apparent from the description and the claims.

DESCRIPTION

Figure 1:
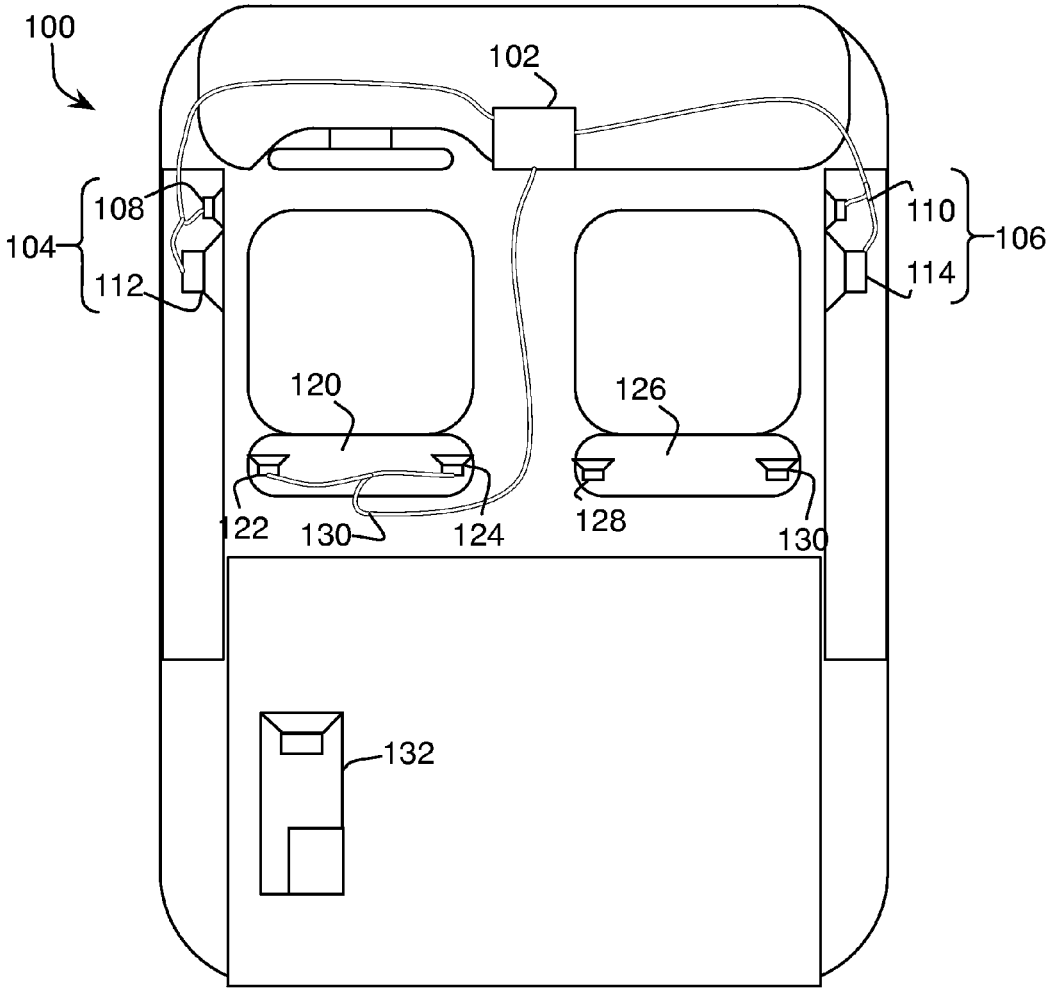
FIG. 1 shows a schematic diagram of a headrest-based audio system in an automobile.

Conventional car audio systems are based around a set of four or more speakers, two on the instrument panel or in the front doors and two generally located on the rear package shelf, in sedans and coupes, or in the rear doors or walls in wagons and hatchbacks. In some cars, however, as shown in FIG. 1, speakers may be provided in the headrest or other close location rather than in the traditional locations behind the driver. This saves space in the rear of the car, and doesn't waste energy providing sound to a back seat that, if even present, is unlikely to be used for passengers. The audio system 100 shown in FIG. 1 includes a combined source/processing/amplifying unit 102. In some examples, the different functions may be divided between multiple components. In particular, the source is often separated from the amplifier, and the processing provided by either the source or the amplifier, though the processing may also be provided by a separate component. The processing may also be provided by software loaded onto a general purpose computer providing functions of the source and/or the amplifier. We refer to signal processing and amplification provided by "the system" generally, without specifying any particular system architecture or technology.

The audio system shown in FIG. 1 has two sets of speakers 104, 106 permanently attached to the vehicle structure. We refer to these as "fixed" speakers. In the example of FIG. 1, each set of fixed speakers includes two speaker elements, commonly a tweeter 108, 110, and a low-to-mid range speaker element 112, 114. In another common arrangement, the smaller speaker is a mid-to-high frequency speaker element and the larger speaker is a woofer, or low-frequency speaker element. The two or more elements may be combined into a single enclosure or may be installed separately. The speaker elements in each set may be driven by a single amplified signal from the amplifier, with a passive crossover network (which may be embedded in one or both speakers) distributing signals in different frequency ranges to the appropriate speaker elements. Alternatively, the amplifier may provide a band-limited signal directly to each speaker element. In other examples, full range speakers are used, and in still other examples, more than two speakers are used per set. Each individual speaker shown may also be implemented as an array of speakers, which may allow more sophisticated shaping of the sound, or simply a more economical use of space and materials to deliver a given sound pressure level.

The driver's headrest 120 in FIG. 1 includes two speakers 122, 124, which again are shown abstractly and may in fact each be arrays of speaker elements. The two 122, 124 speakers (whether individual speakers or arrays) may be operated cooperatively as an array themselves to control the distribution of sound to the listener's ears. The speakers are located close to the listener's ears, and are referred to as near-field speakers. In some examples, they are located physically inside the headrest. The two speakers may be located at either end of the headrest, roughly corresponding to the expected separation of the driver's ears, leaving space in between for the cushion of the headrest, which is of course its primary function. In some examples, the speakers are located closer together at the rear of the headrest, with the sound delivered to the front of the headrest through an enclosure surrounding the cushion. The speakers may be oriented relative to each other and to the headrest components in a variety of ways, depending on the mechanical demands of the headrest and the acoustic goals of the system. Co-pending application Ser. No. 13/799,703, incorporated here by reference, describes several designs for packaging the speakers in the headrest without compromising the safety features of the headrest. The near-field speakers are shown in FIG. 1 as connected to the source 102 by cabling 130 going through the seat, though they may also communicate with the source 102 wirelessly, with the cabling providing only power. In another arrangement, a single pair of wires provides both digital data and power for an amplifier embedded in the seat or headrest.

A small-car audio system may be designed in part to optimize the experience of the driver, and not provide near-field speakers for the passenger. A passenger headrest 126 with additional speakers 128 and 130 and a rear-mounted bass box 132 may be offered as options to a buyer who does want to provide the same enhanced sound for the passenger or further increase the bass output of the system, even if that means sacrificing valuable storage space for increased audio performance. When such optional speakers are installed, the tuning of the entire audio system is adjusted to make the best use of the added speakers, as described in co-pending application Ser. No. 13/888,392, filed simultaneously with this application.

Binaural Response and Correction

Figure 2:
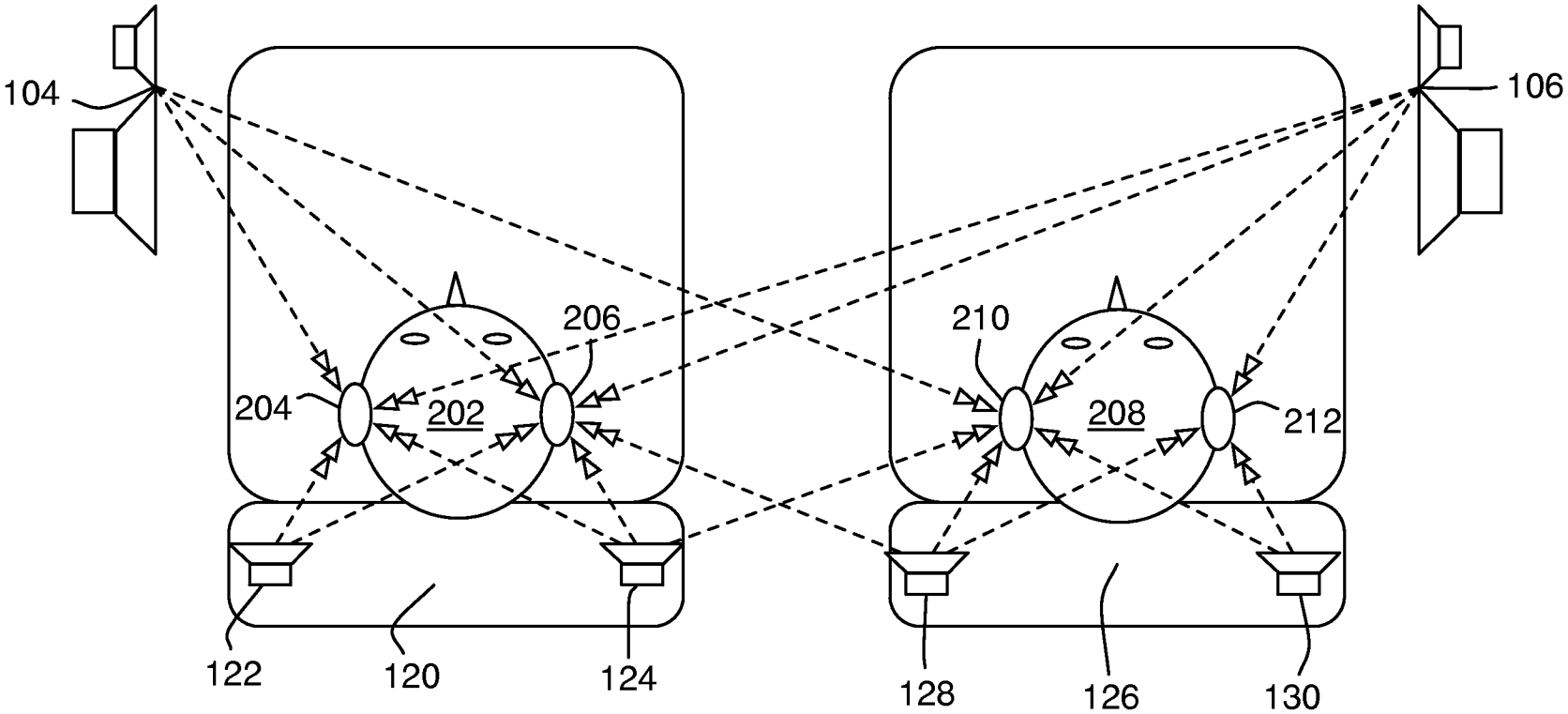
FIG. 2 shows paths by which sound from each of the speakers in the system of FIG. 1 reaches the ears of listeners.

FIG. 2 shows two listener's heads as they are expected to be located relative to the speakers from FIG. 1. Driver 202 has a left ear 204 and right ear 206, and passenger 208's ears are labeled 210 and 212. Dashed arrows show various paths sound takes from the speakers to the listeners' ears as described below. We refer to these arrows as "signals" or "paths," though in actual practice, we are not assuming that the speakers can control the direction of the sound they radiate, though that may be possible. Multiple signals assigned to each speaker are superimposed to create the ultimate output signal, and some of the energy from each speaker may travel omnidirectionally, depending on frequency and the speaker's acoustic design. The arrows merely show conceptually the different combinations of speaker and ear for easy reference. If arrays or other directional speaker technology is used, the signals may be provided to different combinations of speakers to provide some directional control. These arrays could be in the headrest as shown or in other locations relatively close to the listener including locations in front of the listener.

The near-field speakers can be used, with appropriate signal processing, to expand the spaciousness of the sound perceived by the listener, and more precisely control the frontal soundstage. Different effects may be desired for different components of the audio signals—center signals, for example, may be tightly focused, while surround signals may be intentionally diffuse. One way the spaciousness is controlled is by adjusting the signals sent to the near-field speakers to achieve a target binaural response at the listeners ears. As shown in FIG. 2 and more clearly in FIG. 3, each of the driver's ears 204, 206 hears sound generated by each local near-field speaker 122 and 124. The passenger similarly hears the speakers near the passengers head. In addition to differences due to the distance between each speaker and each ear, what each ear hears from each speaker will vary due to the angle at which the signals arrive and the anatomy of the listener's outer ear structures (which may not be the same for their left and right ears). Human perception of the direction and distance of sound sources is based on a combination of arrival time differences between the ears, signal level differences between the ears, and the particular effect that the listener's anatomy has on sound waves entering the ears from different directions, all of which is also frequency-dependent. We refer to the combination of these factors at both ears, for a source at a given location, as the binaural response for that location. Binaural signal filters are used to shape sound that will be reproduced at a speaker at one location to sound like it originated at another location.

Figure 3:
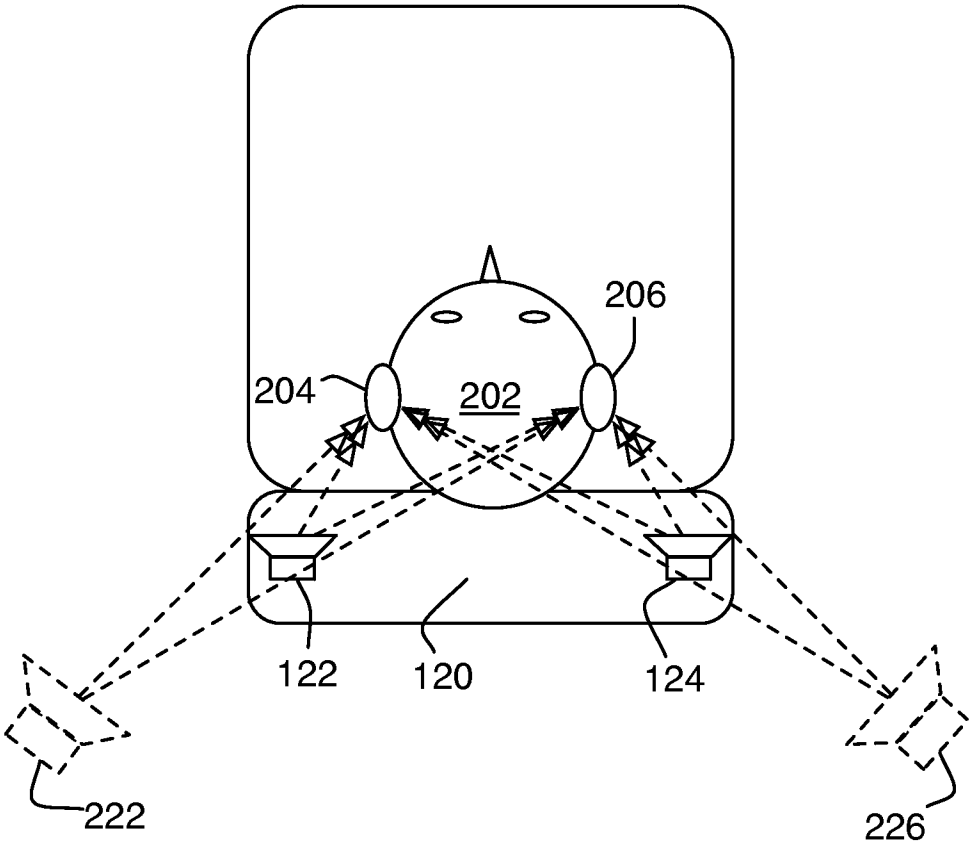
FIGS. 3 and 4 show the relationship between virtual speaker locations and real speaker locations.

Although a system cannot be designed a priori to account for the unique anatomy of an unknown future user, other aspects of binaural response can be measured and manipulated. FIG. 3 shows two "virtual" sound sources 222 and 226 corresponding to locations where surround speakers might ideally be located in a car that had them. In an actual car, however, such speakers would have to be located in the vehicle structure, which is unlikely to allow them to be in the location shown. Given these virtual sources' locations, the arrows showing sound paths from those speakers arrive at the user's ears at slightly different angles than the sound paths from the near-field speakers 122 and 124. Binaural signal filters modify the sound played back at the near-field speakers so that the listener perceives the filtered sound as if it is coming from the virtual sources, rather than from the actual near-field speakers. In some examples, it is desirable for the sound the driver perceives to seem as if it is coming from a diffuse region of space, rather than from a discrete virtual speaker location. Appropriate modifications to the binaural filters can provide this effect, as discussed below.

The signals intended to be localized from the virtual sources are modified to attain a close approximation to the target binaural response of the virtual source with the inclusion of the response from near-field speakers to ears. Mathematically, we can call the frequency-domain binaural response to the virtual sources $V(s)$, and the response from the real speakers, directly to the listener's ears $R(s)$. If a sound $S(s)$ were played at the virtual sources, the user would hear $S(s)\times V(s)$. For same sound played at the near-field speakers, without correction, the user will hear $S(s)\times R(s)$. Ideally, by first filtering the signals with a filter having a transfer function equivalent to $V(s)/R(s)$, the sound $S(s)\times V(s)/R(s)$ will be played back over the near-field speakers, and the user will hear $S(s)\times V(s)\times R(s)/R(s)=S(s)\times V(s)$. There are limits to how far this can be taken—if the virtual source locations are too far from the real near-field speaker locations, for example, it may be impossible to combine the responses in a way that produces a stable filter or it may be very susceptible to head movement. One limiting factor is the cross-talk cancellation filter, described below, which prevents signals meant for one ear from reaching the other ear.

Component Signal Distribution

One aspect of the audio experience that is controlled by the tuning of the car is the sound stage. "Sound stage" refers to the listener's perception of where the sound is coming from. In particular, it is generally desired that a sound stage be wide (sound comes from both sides of the listener), deep (sound comes from both near and far), and precise (the listener can identify where a particular sound appears to be coming from). In an ideal system, someone listening to recorded music can close their eyes, imagine that they are at a live performance, and point out where each musician is located. A related concept is "envelopment," by which we refer to the perception that sound is coming from all directions, including from behind the listener, independently of whether the sound is precisely localizable. Perception of sound stage and envelopment (and sound location generally) is based on level and arrival-time (phase) differences between sounds arriving at both of a listener's ears, soundstage can be controlled by manipulating the audio signals produced by the speakers to control these inter-aural level and time differences. As described in U.S. Pat. No. 8,325,936, incorporated here by reference, not only the near-field speakers but also the fixed speakers may be used cooperatively to control spatial perception.

If a near-field speaker-based system is used alone, the sound will be perceived as coming from behind the listener, since that is indeed where the speakers are. Binaural filtering can bring the sound somewhat forward, but it isn't sufficient to reproduce the binaural response of a sound truly coming form in front of the listener. However, when properly combined with speakers in front of the driver, such as in the traditional fixed locations on the instrument panel or in the doors, the near-field speakers can be used to improve the staging of the sound coming from the front speakers. That is, in addition to replacing the rear-seat speakers to provide "rear" sound, the near-field speaker are used to focus and control the listener's perception of the sound coming from the front of the car. This can provide a wider or deeper, and more controlled, sound stage than the front speakers alone could provide. The near-field speakers can also be used to provide different effects for different portions of the source audio. For example, the near-field speakers can be used to tighten the center image, providing a more precise center image than the fixed left and right speakers alone can provide, while at the same time providing more diffuse and enveloping surround signals than conventional rear speakers.

In some examples, the audio source provides only two channels, i.e., left and right stereo audio. Two other common options are four channels, i.e., left and right for both front and rear, and five channels for surround sound sources (usually with a sixth "point one" channel for low-frequency effects). Four channels are normally found when a standard automotive head unit is used, in which case the two front and two rear channels will usually have the same content, but may be at different levels due to "fader" settings in the head unit. To properly mix sounds for a system as described herein, the two or more channels of input audio are up-mixed into an intermediate number of components corresponding to different directions from which the sound may appear to come, and then re-mixed into output channels meant for each specific speaker in the system, as described with reference to FIGS. 4 through 6. One example of such up-mixing and re-mixing is described in U.S. Pat. No. 7,630,500, incorporated here by reference.

Figure 4:
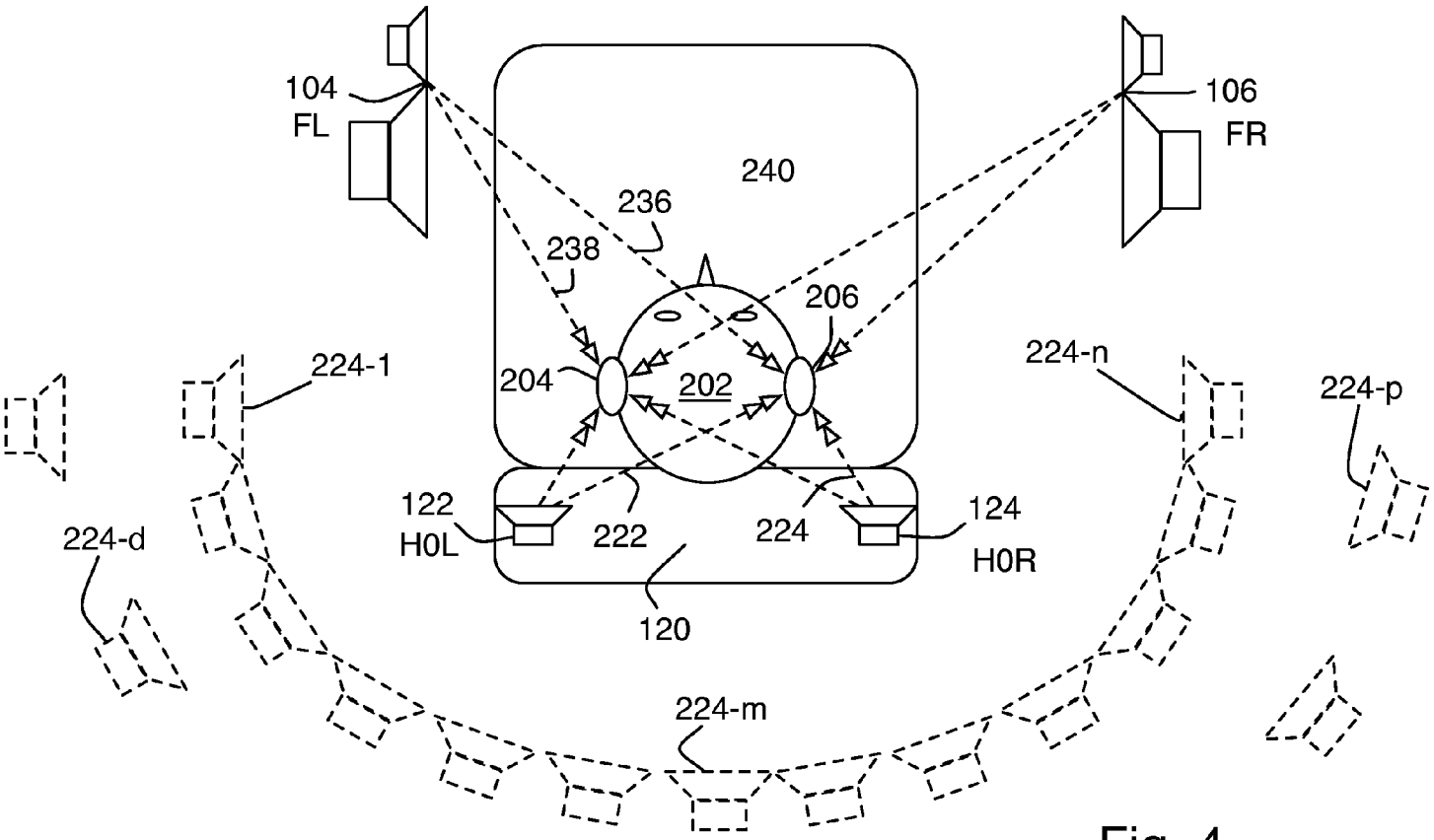

An advantage of the present system is that the component signals up-mixed from the source material can each be distributed to different virtual speakers for rendering by the audio system. As explained with regard to FIG. 3, the near-field speakers can be used to make sound seem to be coming from virtual speakers at different locations. As shown in FIG. 4, an array of virtual speakers 224*i* can be created surrounding the listener's rear hemisphere. Five speakers, 224-1, 224-*d*, 224-*m*, 224-*n*, and 224-*p* are labeled for convenience only. The actual number of virtual speakers may depend on the processing power of the system used to generate them, or the acoustic needs of the system. Although the virtual speakers are shown as a number of virtual speakers on the left (e.g., 224-1 and 224-*d*) and right (e.g., 224-*n* and 224-*p*) and one in the center (224-*m*), there may also be multiple virtual center speakers, and the virtual speakers may be distributed in height as well as left, right, front, and back.

A given up-mixed component signal may be distributed to any one or more of the virtual speakers, which not only allows repositioning of the component signal's perceived location, but also provides the ability to render a given component as either a tightly focused sound, from one of the virtual speakers, or as a diffuse sound, coming from several of the virtual speakers simultaneously. To achieve these effects, a portion of each component is mixed into each output channel (though that portion may be zero for some component-output channel combinations). For example, the audio signal for a right component will be mostly distributed to the right fixed speaker FR 106, but to position each virtual image 224-1 on the right side of the headrest, such as 224-*n* and 224-*p*, portions of the right component signal are also distributed to the right near-field speaker and left near-field speaker, due to both the target binaural response of the virtual image and for cross-talk cancellation. The audio signal for the center component will be distributed to the corresponding right and left fixed speakers 104 and 106, with some portion also distributed to both the right and left near-field speakers 122 and 124, controlling the location, e.g., 224-*m*, from which the listener perceives the virtual center component to originate. Note that the listener won't actually perceive the center component as coming from behind if the system is tuned properly—the center component content coming from the front fixed speakers will pull the perceived location forward, the virtual center simply helps to control how tight or diffuse, and how far forward, the center component image is perceived. The particular distribution of component content to the output channels will vary based on how many and which near-field speakers are installed. Mixing the component signals for the near-field speakers includes altering the signals to account for the difference between the binaural response to the components, if they were coming from real speakers, and the binaural response of the near-field speakers, as described above with reference to FIG. 3.

FIG. 4 also shows the layout of the real speakers, from FIG. 1. The real speakers are labeled with notations for the signals they reproduce, i.e., left front (LF), right front (FR), left driver headrest (H0L), and right driver headrest (H0R). While the output signals FL and FR will ultimately be balanced for both the driver and passenger seats, the near-field speakers allow the driver and passenger to perceive the left and right peripheral components and the center component closer to the ideal locations. If the near-field speakers cannot on their own generate a forward-staged component, they can be used in combination with the front fixed speakers to move the left and right components outboard and to control where the user perceives the center components. An additional array of speakers close to but forward of the listener's head would allow the creation of a second hemisphere of virtual locations in front of the listener.

Figure 5:
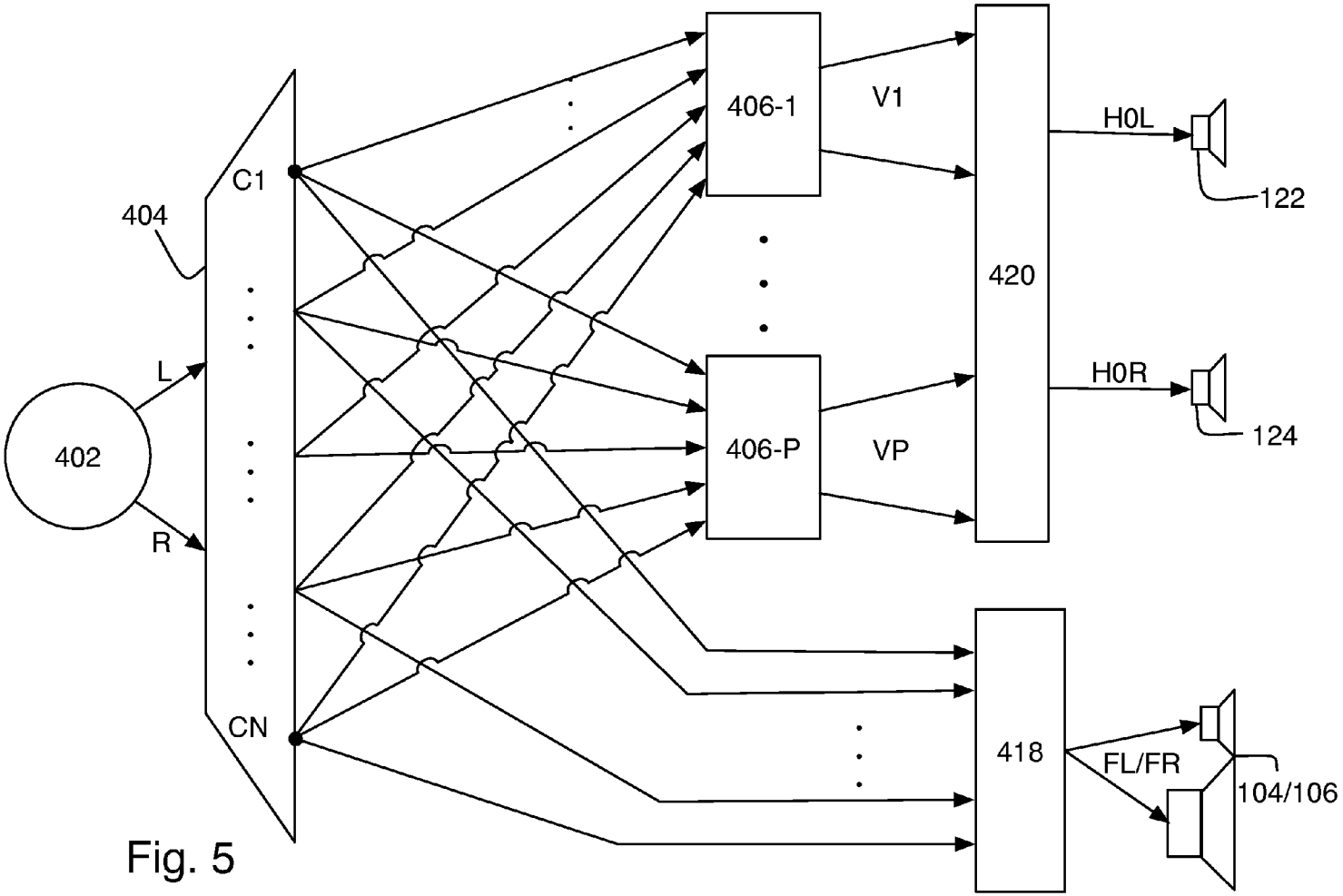
FIG. 5 schematically shows the process of up-mixing and re-mixing audio signals.

We use "component" to refer to each of the intermediate directional assignments to which the original source material is up-mixed. As shown in FIG. 5, a stereo signal is up-mixed into an arbitrary number N of component signals. For one example, there may be a total of five: front and surround for each of left and right, plus a center component. In such an example, the main left and right components may be derived from signals which are found only in the corresponding original left or right stereo signals. The center components may be made up of signals that are correlated in both the left and right stereo signals, and in-phase with each other. The surround components are correlated but out of phase between the left and right stereo signals. Any number of up-mixed components may be possible, depending on the processing power used and the content of the source material. Various algorithms can be used to up-mix two or more signals into any number of component signals. One example of such up-mixing is described in U.S. Pat. No. 7,630,500, incorporated here by reference. Another example is the Pro Logic IIz algorithm, from Dolby®, which separates an input audio stream into as many as nine components, including height channels. In general, we treat components as being associated with left, right, or center. Left components are preferably associated with the left side of the vehicle, but may be located, front, back, high, or low. Similarly right components are preferably associated with the right side of the vehicle, and may be located front, back, high, or low. Center components are preferably associated with the centerline of the vehicle, but may also be located front, back, high, or low. FIG. 5 shows an arbitrary number N of up-mixed components.

The relationship between component signals, generally C1 through CN, virtual image signals, V1 through VP, and output signals FL, FR, H0L, and H0R is shown in FIG. 5. A source 402 provides two or more original channels, shown as L and R. An up-mixing module 404 converts the input signals L and R into a number, N, of component signals C1 through CN. There may not be a discrete center component, but center may be provided a combination of one or more left and right components. Binaural filters 406-1 through 406-P then convert weighted sums of the up-mixed component signals into a binaural signal corresponding to sound coming from the virtual image locations V1 through VP, corresponding to the virtual speakers 224-*i* shown in FIG. 4. While FIG. 5 shows each of the binaural filters receiving all of the component signals, in practice, each virtual speaker location will likely reproduce sounds from only a subset of the component signals, such as those signals associated with the corresponding side of the vehicle. As with the component signals, a virtual center signal may actually be a combination of left and right virtual images. Re-mixing stages 418 (only one shown) recombine the up-mixed component signals to generate the FL and FR output signals for delivery to the front fixed speakers, and a binaural mixing stage 420 combines the binaural virtual image signals to generate the two headrest output channels H0L and H0R. The same process is used to generate output signals for the passenger headrest and any additional headrest or other near-field binaural speaker arrays, and additional re-mixing stages are used to generate output signals for any additional fixed speakers. Various topologies of when component signals are combined and when they are converted into binaural signals are possible, and may be selected based on the processing capabilities of the system used to implement the filters, or on the processes used to define the tuning of the vehicle, for example.

Figure 6:
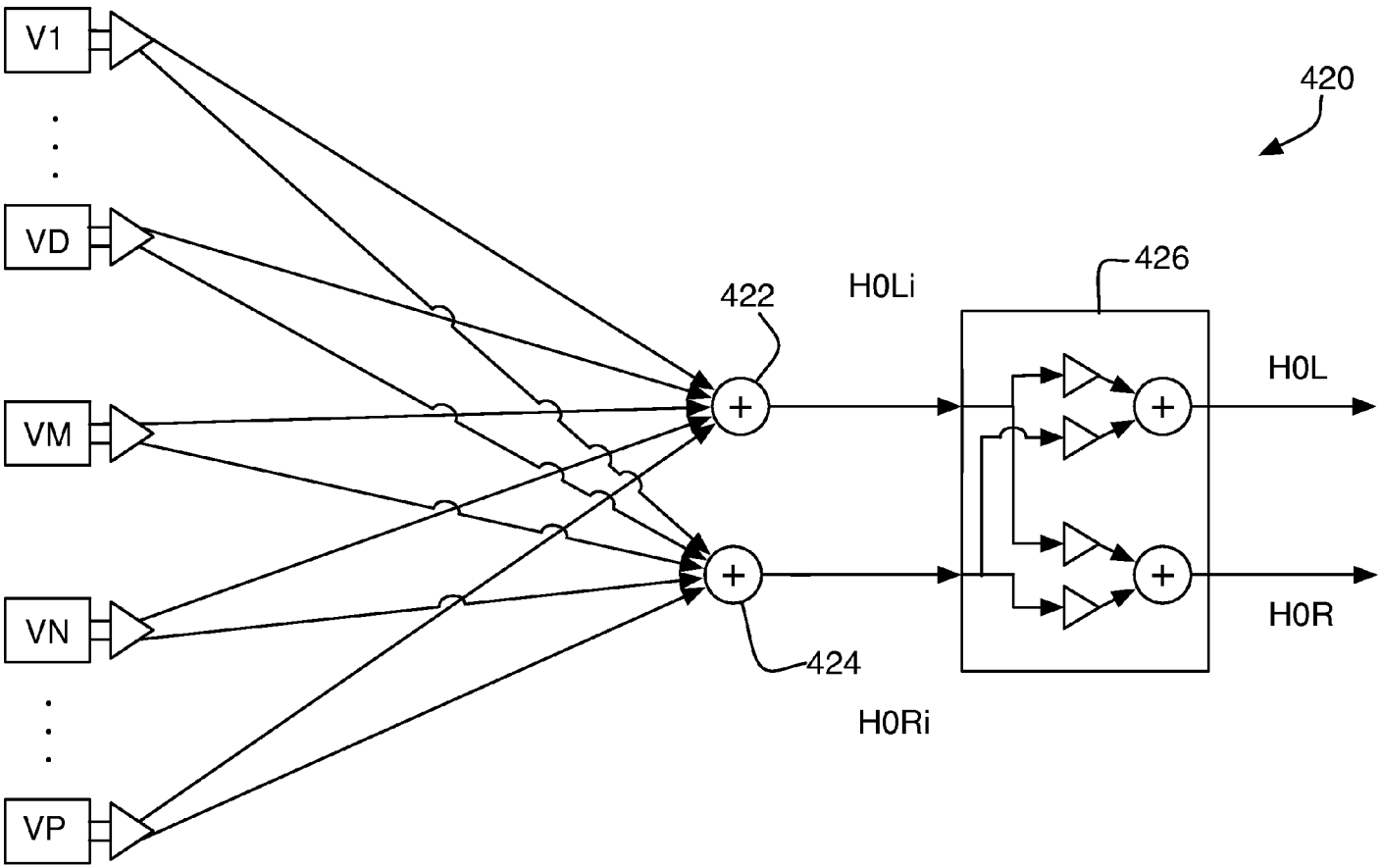
FIGS. 6 and 7 show signal flows within the re-mixing stages of FIG. 5.

FIG. 6 shows the signal flows within the near-field mixing stage 420. P binaural virtual input signals Vi are received at the left, the five shown corresponding to the virtual speakers numbered 224-1, 224-*d*, 224-*m*, 224-*n*, and 224-*p* in FIG. 4, and two output signals are provided on the right. Each of the output signals is driven by a mixing stage 422, 424. Before mixing, each of the binaural signals is filtered to create the desired soundstage. The filters apply frequency response equalization of magnitude and phase to each of the input virtual signals. The filters may also be located before the binaural filters from FIG. 5, or integrated within them. The actual signal processing topology will depend on the hardware and tuning techniques used in a given application. The mixing stages each have P inputs, one for the corresponding half of each binaural virtual input signal. The filtered signals for each ear are summed to generate initial binaural output signals H0Li and H0Ri.

An additional stage 426 operates on the initial near-field output channels after they have been generated by the mixing stages 422 and 424. This cross-talk cancellation stage 426 mixes a filtered version of each near-field output channel into the signal for the other speaker in the same near-field pair or array. This filtered signal is shifted in phase and gain, among other modifications, to provide a cancellation component in the output signal that will cancel sound from the opposite near-field speaker. Such cancellation is described in detail in U.S. Pat. No. 8,325,936, incorporated here by reference.

Figure 7:
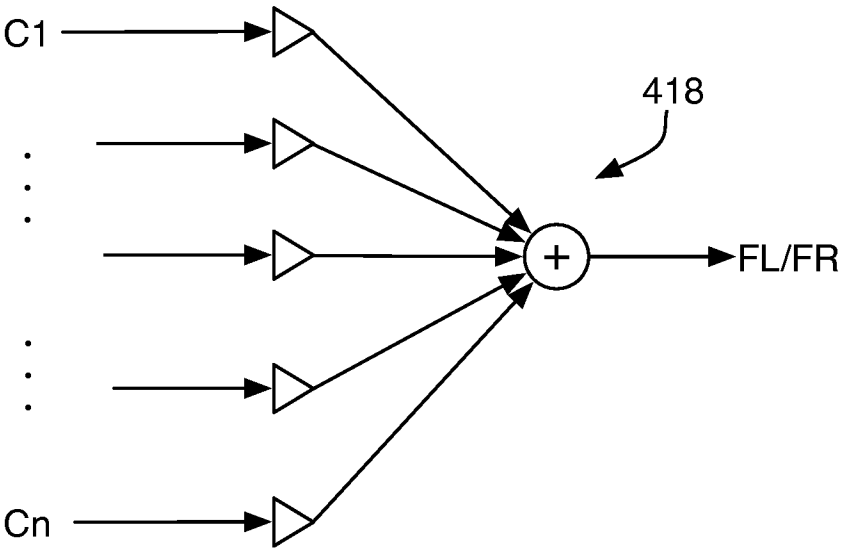

Similar, but simpler, mixing is done in the re-mixing stages 418 to generate mixed output signals such as FL and FR for the fixed speakers, as shown in FIG. 7. For each fixed speaker, the components C1 through CN are each filtered, as in the near-field mixing stage, and combined. By re-combining the components with different weights than they originally had in the stereo signal, various effects can be applied to the signal as discussed below. In some cases, one or more of the filters may apply zero gain, such that there is no portion of one component in a given output signal. For example, some or all of the right components may be entirely absent from the left fixed output channel FL. A similar process of weighting and combining the component signals is used in the binaural filters 406-*i* in FIG. 5. While the figures show all up-mixed components being mixed into all virtual signals and all fixed-speaker output channels, and all virtual signals being re-mixed into the binaural near-field output channels, there will generally be constraints imposed on the mixing. In some examples, only components corresponding to the left stereo channel will be distributed to virtual signals on the left side of the vehicle, and similarly for the right.

Embodiments of the systems and methods described above may comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other embodiments are within the scope of the following claims.

What is claimed is:

1. A method of mixing audio signals, the method comprising:

receiving a number M of input channels, wherein M is two or more, up-mixing the input channels into a number N of component channels, wherein N is greater than M, adjusting the frequency response equalization of the phase or magnitude of each of the N component channels, the adjustment being different for at least two of the N component channels, re-mixing the adjusted component channels into a number P of fixed-speaker output channels, providing the P fixed-speaker output channels, generating a number Q of binaural signal pairs from the N component channels, adjusting the frequency response equalization of the phase or magnitude of each of the Q binaural signal pairs, the adjustment being different for at least two of the Q binaural signal pairs, and re-mixing the adjusted binaural signal pairs into a number R of binaural output channels.

2. The method of claim 1 wherein P is equal to N.

3. The method of claim 1 wherein re-mixing the adjusted component channels comprises, to generate each output channel, computing a weighted sum of a subset of the adjusted component channels.

4. A method of mixing audio signals, the method comprising:

receiving a number M of input channels, wherein M is two or more, up-mixing the input channels into a number N of component channels, wherein N is greater than M, adjusting the frequency response equalization of the phase or magnitude of each of the N component channels, the adjustment being different for at least two of the N component channels, re-mixing the adjusted component channels into a number P of fixed-speaker output channels, providing the P fixed-speaker output channels, generating a number Q of binaural signal pairs from the adjusted component channels, and re-mixing the adjusted binaural signal pairs into a number R of binaural output channels.

* * * * *